US005934468A

United States Patent [19]

Scott

[11] Patent Number: 5,934,468

[45] Date of Patent: Aug. 10, 1999

[54] FLUORESCENT LIGHT HOLSTER

[76] Inventor: Ronnie Scott, 16222 Clay Rd. #1301, Houston, Tex. 77084

[21] Appl. No.: 08/972,643

[22] Filed: Nov. 18, 1997

[51] Int. Cl.[6] ..... B65D 85/42

[52] U.S. Cl. ..... 206/418; 206/419; 182/129

[58] Field of Search ..... 206/419, 420, 206/443, 418; 383/40, 39; 182/129

[56] References Cited

U.S. PATENT DOCUMENTS

| | | | |
|---|---|---|---|
| 1,214,282 | 1/1917 | Day | 206/286 |
| 1,555,058 | 9/1925 | Hogue | 206/349 |
| 3,151,649 | 10/1964 | Mitchell, Jr. | 150/1 |
| 4,738,547 | 4/1988 | Brown | 383/39 |
| 4,858,763 | 8/1989 | Scott | 206/419 |
| 4,901,464 | 2/1990 | Banoun | 42/95 |
| 5,174,447 | 12/1992 | Fleming | 206/373 |
| 5,257,694 | 11/1993 | Wallach | 206/286 |
| 5,503,476 | 4/1996 | Hamdan | 383/9 |
| 5,577,607 | 11/1996 | Drake et al. | 206/349 |

*Primary Examiner*—Paul T. Sewell
*Assistant Examiner*—Trinh Nguyen
*Attorney, Agent, or Firm*—Jenkens & Gilchrist, P.C.

[57] ABSTRACT

A light bulb holster (10) is provided in which pockets (18,36) are used to hold a plurality of tubular bulbs (22). A flap (28) is operable to cover the top ends of the bulbs (22) during transport and to secure the holster (10) to a ladder brace at the work site. A pouch (40) is provided on top of the holster (10), near the openings of the pockets (18, 36), for storing ballasts (48). Additional pockets (50) are also provided on top of the pouch (40) for storage of tags (54), starters (56), and nuts and bolts (58). Furthermore, at least one slot (62) may be included between at least two of the additional pockets (50) for holding a fastening tool (68) for the nuts and bolts (58), such as a screwdriver, wrench, or power tool.

12 Claims, 1 Drawing Sheet

FLUORESCENT LIGHT HOLSTER

FIELD OF THE INVENTION

This invention pertains in general to an electric lamp holder, and more particularly to a flexible holster for aiding the process of changing fluorescent light bulbs.

BACKGROUND OF THE INVENTION

During installation of fluorescent light bulbs, it is often necessary to employ a stepladder in order to reach the fluorescent lamp fixture. Since both hands are normally necessary to remove or install a fluorescent lamp from the fixture, it is necessary to utilize some aid in transferring the fluorescent light bulbs to and from the fixture.

U.S. Pat. No. 4,613,042 to Aeschliman discloses one such device. The Aeschliman device comprises a plurality of tapered, rigid tubes of different lengths, integrally jointed together, such that a plurality of lamps can be held by the tubes at selected heights. The tubes may be clamped to one end of a stepladder using a vise-like mechanism.

The Aeschliman device has several deficiencies. First, only a small portion of one end of the fluorescent light bulb is contained in the tubes, thereby exposing the large length of the fluorescent light bulb. Thus, the entire bulb is not protected from external forces. The Aeschliman device is rigidly attached to the ladder, and a force imparted to the bulbs would result in their breakage or dislodging. Furthermore, the Aeschliman device is not suitable for holding bulbs in a non-vertical position. As a result, the Aeschliman device cannot be used to aid in transporting the bulbs, and therefore has only limited application.

U.S. Pat. No. 4,858,763 to Scott discloses another such device. The Scott device is a light bulb holster in which pockets are used to hold a plurality of tubular bulbs. A flap is operable to cover the top ends of the bulbs during transport and to secure the holster to a ladder brace at the work site. A loop is also provided on the back of the holster for carrying the holster.

However, the Scott device also has several deficiencies. First, the holster is designed to only carry tubular bulbs. When removing or installing a fluorescent light fixture, additional parts, such as starters and ballasts, may also need to be removed or installed. These additional parts would have to be carried separately, and would possibly require the workman to descend the ladder to obtain or dispose of the parts. Furthermore, the Scott device does not provide any storage for tools, such as nuts, bolts, and a screwdriver. Thus, an additional holster, such as a toolbelt would have to be used when installing a fluorescent light.

It is therefore an object of the invention to provide a light bulb holster, capable of storing all necessary parts and tools, which is easily transportable, and which offers maximum protection to the bulbs.

SUMMARY OF THE INVENTION

The present invention is directed to a light bulb holster, which substantially eliminates or prevents the disadvantages and problems associated with prior light bulb holding devices. The light holster of the present invention comprises a flexible bag including a plurality of pockets for holding long light bulbs. Cushions are provided at the bottom of each pocket to protect the ends of the bulb. A loop is provided on the back of the bag for carrying the holster, or for attaching the bag to the user's belt. A top flap may be secured to the front of the bag, thereby securing the light bulbs within the pockets, or to the back of the bag to provide an attachment to the brace of the ladder. A pouch is provided on top of the bag, near the openings of the pockets, for storing ballasts, which provide thermal protection for the bulbs, and which can be replaced or removed in addition to the bulbs. Additional pockets are also provided on top of the pouch for storage of tags, such as hazardous material tags, starters, which produce an electrical spark to light the bulbs, and nuts and bolts for securing the bulbs, ballasts, and starters together. Furthermore, at least one slot may be included between at least two of the additional pockets for holding a tool for fastening the nuts and bolts, such as a screwdriver, wrench, or power tool.

BRIEF DESCRIPTION OF THE DRAWINGS

For a more complete understanding of the present invention and the advantages thereof, reference is now made to the following descriptions taken in conjunction with the accompanying drawings, in which.

DETAILED DESCRIPTION

The numerous innovative teachings of the present application will be described with particular reference to the presently preferred exemplary embodiments. However, it should be understood that this class of embodiments provides only a few examples of the many advantageous uses of the innovative teachings herein. In general, statements made in the specification of the present application do not necessarily delimit any of the various claimed inventions. Moreover, some statements may apply to some inventive features but not to others.

Figure 1:
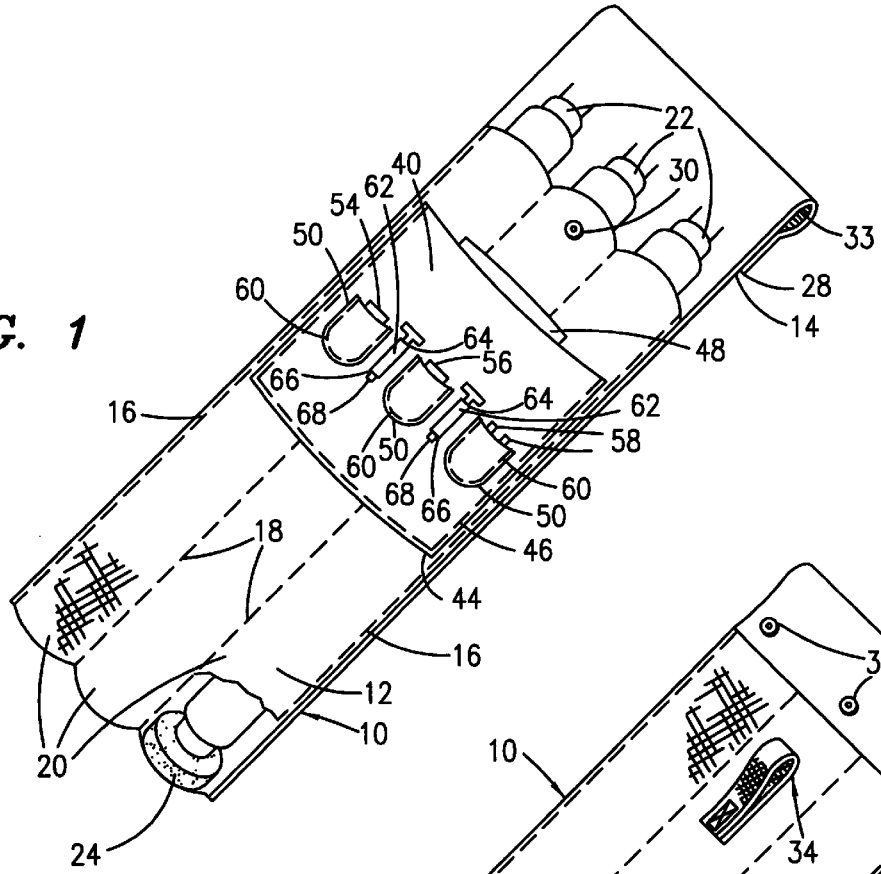
FIG. 1 illustrates a front perspective view of the light holster of the present invention, having a cutaway view showing the cushioning at the bottom of the holster's pockets.
Figure 2:
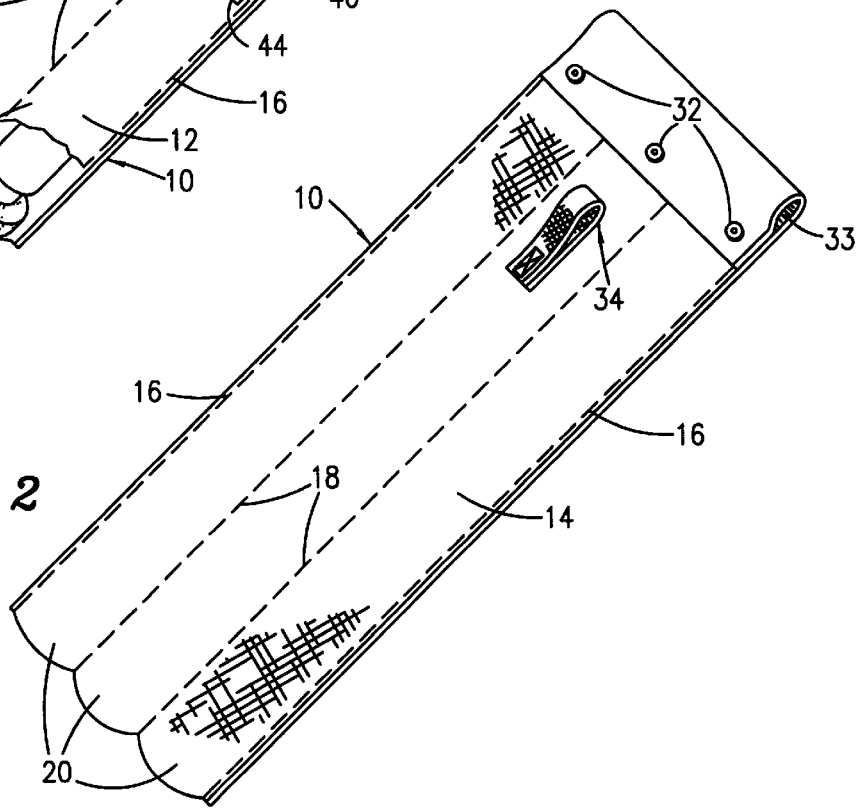
FIG. 2 illustrates a back perspective view of the light holster of the present invention.

FIGS. 1 and 2 illustrate perspective front and back views, respectively, of the present invention. The light holster 10 comprises a bag formed of front and back pieces of material 12 and 14, respectively. Outside seams 16 secure the edges of the front and back material 12 and 14 together, creating an enclosure therebetween. Interior seams 18 create elongated pockets 20 for holding fluorescent light bulbs 22, or other tubular light bulbs. FIG. 1 illustrates a cutaway view of the bottom of a pocket 20. A pad 24 is disposed at the bottom of the pockets 20 to protect the ends of the bulbs 22. If desired, the interior sides of the front and back material may be padded to protect the bulbs 22 from damage by exterior forces.

The back material 14 includes an extended portion providing a flap 28. A front snap 30 is provided on the front material 12 for securing the flap 28 in a position covering the bulbs 22. In this position, the front snap 30 engages a corresponding snap (not shown) on the interior side of the flap 28.

Back snaps 32 are provided on the flap 28 and the exterior of the back material 14. The flap 28 may be folded towards the back of the holster 10 and engaged using the back snaps, in order to form a channel 33 within the flap 28. A strap 34 is provided for carrying the holster 10.

The holster 10 also includes a pouch 40 on top of the holster 10, near the front snap 30, for storing ballasts 48, which provide thermal protection for the bulbs 22. Seam 44 and seams 46, which are parallel to seams 16, create the pouch 40.

Additional shortened pockets 50, as compared to elongated pockets 20, are attached to the pouch 40 for storing light components. These light components can consist of tags 54, such as hazardous materials tags, starters 56, which produce an electrical spark to light the bulbs 22, and nuts and bolts 58. Advantageously, after changing a bulb 22, a hazardous material tag 54 can be secured around the removed bulb 22, which can then be placed in the holster 10 for later disposal. The tag 54 ensures that the removed bulb 22 is not later mistaken for a new bulb 22. The additional pockets 50 can be attached to the pouch 40 using an adhesive to adhere the back (not shown) of each of the pockets 50 to the pouch 40, or by providing seams 60 to create the additional pockets 50.

At least one slot 62 having top and bottom openings 64 and 66, respectively, may be attached between at least two of the additional pockets 50 to hold a fastening tool 68 for the nuts and bolts, such as a screwdriver, wrench, or power tool. Slot 62 can be formed by attaching the ends of a piece of material together and then attaching the ends to the pouch 40, or by attaching the ends of the material to the pouch 40 directly, such that the distance between the ends is less than the length of the material.

In operation, the holster 10 may be used by a workman to carry a plurality of bulbs 22, parts, e.g., ballasts 48, tags 54, starters 56, and nuts and bolts 58, and tools 68 in a protective container. With the flap 28 engaged with the front snap 30, the bulbs are protected on all surfaces and held within the pockets 20.

At the work site, the flap 28 may be disposed about one of the braces disposed on the sides of a ladder and engaged using the back snaps 32. Thus, the holster 10 may be attached to the brace of a ladder by enclosing the brace of the ladder in the channel 33 while the workman is installing the light bulbs 22, such that the light bulbs are readily available without descending the ladder to obtain more bulbs 22. Hence, the present invention provides a more efficient light changing procedure and increases safety by reducing movement on the ladder.

Since the holster 10 is free to pivot about the brace to which it is attached, the light bulbs are protected from exterior forces on the bulbs 22.

It should be noted that the flap 28 may be disposed about other substantially horizontal support structures in lieu of a ladder brace, if a ladder brace is not available.

In preferred embodiments of the present invention, the front and back material 12 and 14 of the holster 10 and the strips of additional material used for the pouch 40, additional pockets 50, and slot 62 are composed of a nylon material. However, other flexible materials may also be used. Furthermore, the snaps 30 and 32 could be replaced by other securing means, such as hook and loop fastening materials (as is sold under the mark "Velcro") or by using zippers.

As will be recognized by those skilled in the art, the innovative concepts described in the present application can be modified and varied over a wide range of applications. Accordingly, the scope of patented subject matter should not be limited to any of the specific exemplary teachings discussed.

What is claimed is:

1. An apparatus for holding tubular light bulbs, comprising:

first and second layers of a flexible material peripherally attached together, said second layer having an extended flap portion;

interior seams defining elongated pockets between said first and second layers, each said elongated pocket having an open end for receiving one of said bulbs;

a third layer of said flexible material peripherally attached to said first layer to define a pouch, said pouch having an open end a ballast inserted within said open end of said pouch;

defining means for defining at least one shortened pocket above said pouch, said shortened pocket having an open end;

at least one light component inserted within said open end of said shortened pocket;

at least one strip of said flexible material having first and second ends, said first and second ends being attached to said pouch to define a slot, said slot having at least one open end; and a fastening tool inserted within said open end of said slot, said fastening tool being operable to install said at least one light component, said ballast and said tubular light bulbs together.

2. The apparatus of claim 1, further comprising front fastening means for securing said extended flap portion to said first layer such that said open ends of said elongated pockets may be covered by said extended flap portion.

3. The apparatus of claim 2, wherein said front fastening means comprises a snap.

4. The apparatus of claim 1, wherein said fastening tool is selected from the group consisting of: a screwdriver, a wrench, and a power tool.

5. The apparatus of claim 1, wherein said fastening tool is selected from the group consisting of: a screwdriver, a wrench, and a power tool.

6. The apparatus of claim 1, wherein said defining means defines at least first and second shortened pockets above said pouch, said slot being located between said first and second shortened pockets.

7. The apparatus of claim 1, further comprising back fastening means for securing said extended flap portion to said second layer to form a loop about a support structure.

8. The apparatus of claim 7, wherein said back fastening means comprises at least one snap.

9. The apparatus of claim 1, wherein said defining means comprises at least a fourth layer of said flexible material peripherally attached to said pouch.

10. The apparatus of claim 1, wherein said defining means comprises fourth and fifth layers of said flexible material peripherally attached together to define said shortened pocket, said fifth layer having a back portion, said back portion being adhered to said pouch.

11. The apparatus of claim 1, further comprising padding material disposed at the bottom of said pockets.

12. The apparatus of claim 1, wherein said first, second and third layers are composed of nylon.

* * * * *